United States Patent [19]

MacDonald

[11] 4,041,582

[45] Aug. 16, 1977

[54] MARINE BURIAL CONTAINER

[76] Inventor: John P. MacDonald, 1914 Dawn Drive, Melbourne, Fla. 32935

[21] Appl. No.: 670,149

[22] Filed: Mar. 25, 1976

[51] Int. Cl.[2] ..... A61G 17/00

[52] U.S. Cl. ..... 27/2

[58] Field of Search ..... 27/1, 2, 3, 6, 7, 17

[56] References Cited

U.S. PATENT DOCUMENTS

| | | | |
|---|---|---|---|
| 649,740 | 5/1900 | Miller | 27/2 |
| 1,660,019 | 2/1928 | Tazza | 27/2 |
| 2,092,697 | 9/1937 | Gramelspacher | 27/2 |
| 3,220,080 | 11/1965 | Connelly | 27/2 |
| 3,732,602 | 5/1973 | Vigh | 27/1 |

*Primary Examiner*—John D. Yasko

*Attorney, Agent, or Firm*—Duckworth, Hobby, Orman, Allen & Pettis

[57] ABSTRACT

A container for sea burials is made of paperboard treated and reinforced for holding a corpse and has openings therein located to prevent the entrapment of air and thereby allow the container to sink more rapidly. The container has concrete members with straps for attachment to the corpse located therein to reduce the buoyancy and to hold the corpse to the floor of the sea.

11 Claims, 5 Drawing Figures

MARINE BURIAL CONTAINER

BACKGROUND OF THE INVENTION

The present invention relates to containers and especially to marine burial containers for burying corpses at sea.

In the past, it has been common to have a great variety of burial containers for burying corpses. Typically, these vary from simple pine boxes to complex metal containers having special seals and decorative interiors. Many of these prior caskets, however, have been directed towards protecting the deceased's body for a long period of time from the rapid disintegration a burial would bring about. Sea burials on the otherhand have been quite common in the past for sailors aboard ships in which the bodies are with ceremony tossed into the sea without the use of containers.

The present invention is directed towards an inexpensive container for sea burials so that bodies may be loaded aboard an ocean vessel, taken out to sea, and buried in an inexpensive manner without having to buy burial plots or have special expensive caskets. One difficulty that arises with sea burial containers is that the containers tend to float if well sealed, and the bodies in the containers will float to the surface after being submerged for a period of time. The present invention, advantageously, overcomes these prior difficulties while providing an inexpensive casket for the shipment and burial of bodies at sea.

SUMMARY OF THE INVENTION

The present invention relates to a marine burial container which is made of paperboard such as corrugated cardboard, or the like, shaped to receive a corpse for burial. The container includes weights of predetermined shape and flexible straps for connecting the weight securely to the corpse for reducing the buoyancy of the container and the corpse. In addition, the container has openings at predetermined locations to prevent the entrapment of air to reduce the buoyancy of the container immediately. The container may be of specially treated paperboard and have a reinforced base for supporting the corpse and weights. The weights are connected to the corpse by means of straps, of the like, to prevent the corpse from floating to the surface if the container breaks up or disintegrates.

BRIEF DESCRIPTION OF THE DRAWINGS

Other objects, features, and advantages of the present invention wil be apparent from the written description and the drawings in which.

DESCRIPTION OF THE PREFERRED EMBODIMENT

Figure 1:
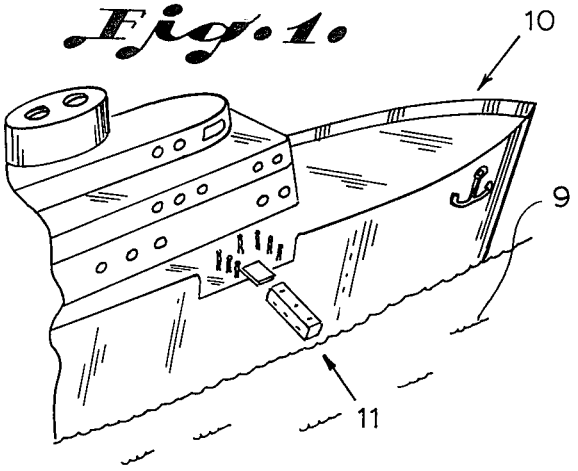
FIG. 1 is a perspective view of a portion of a sea going vessel having a sea burial utilizing a container in accordance with the present invention.
Figure 2:
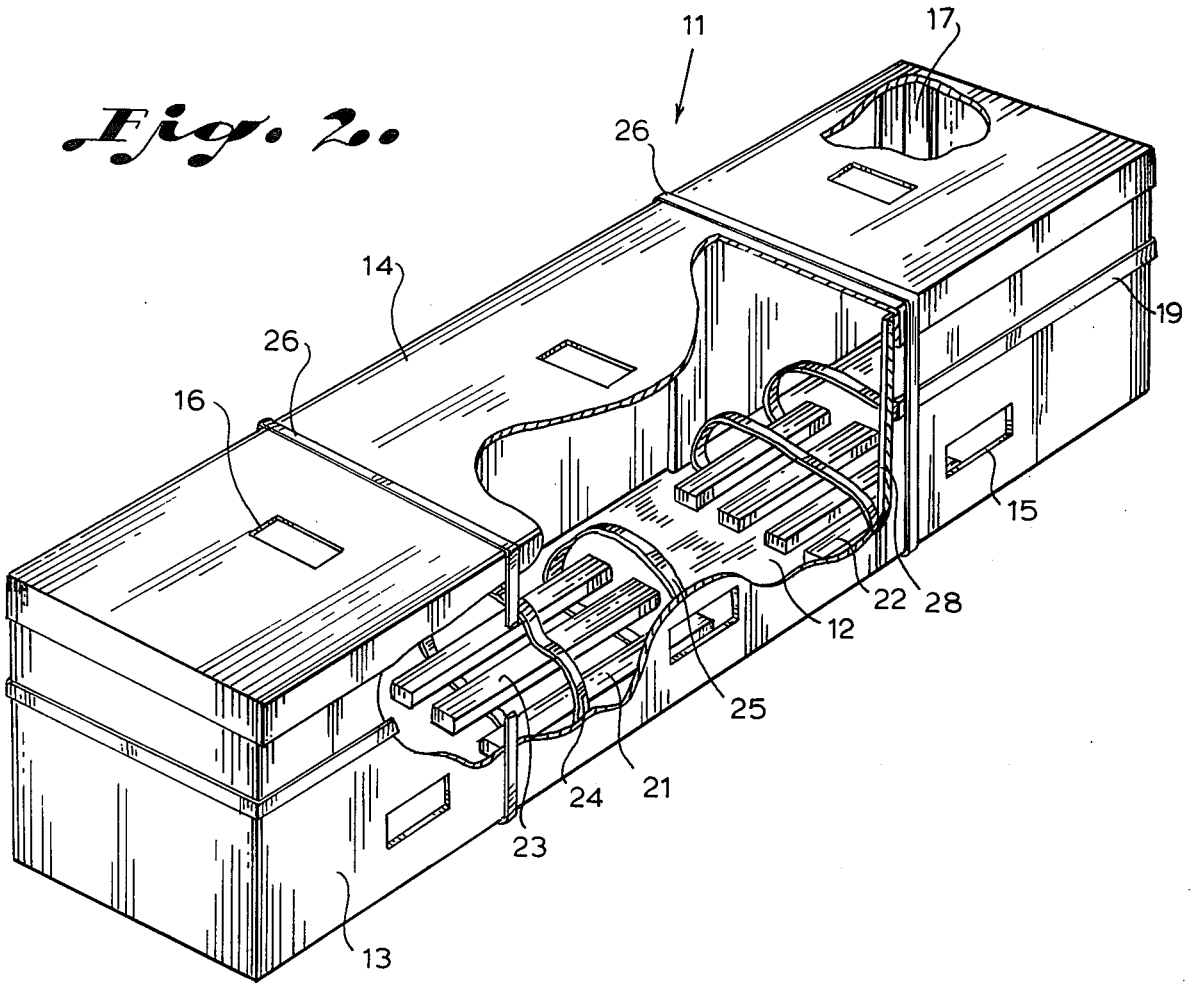
FIG. 2 is a cutaway perspective view of a burial container in accordance with the present invention.
Figure 3:
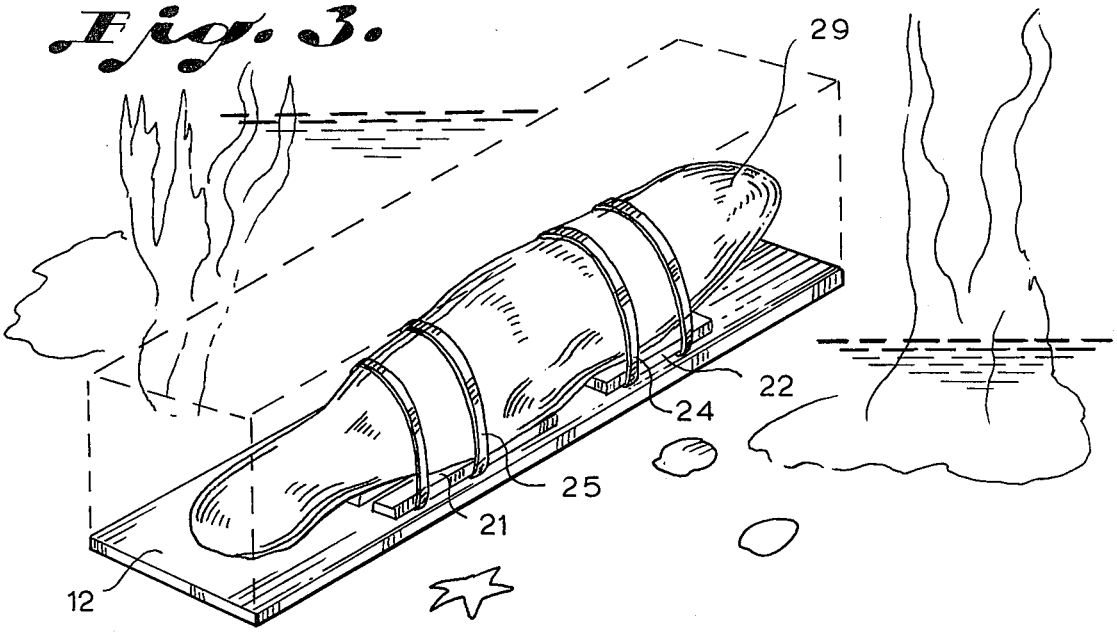
FIG. 3 is a perspective view of a corpse attached to the weights sitting on the base of the container.
Figure 4:
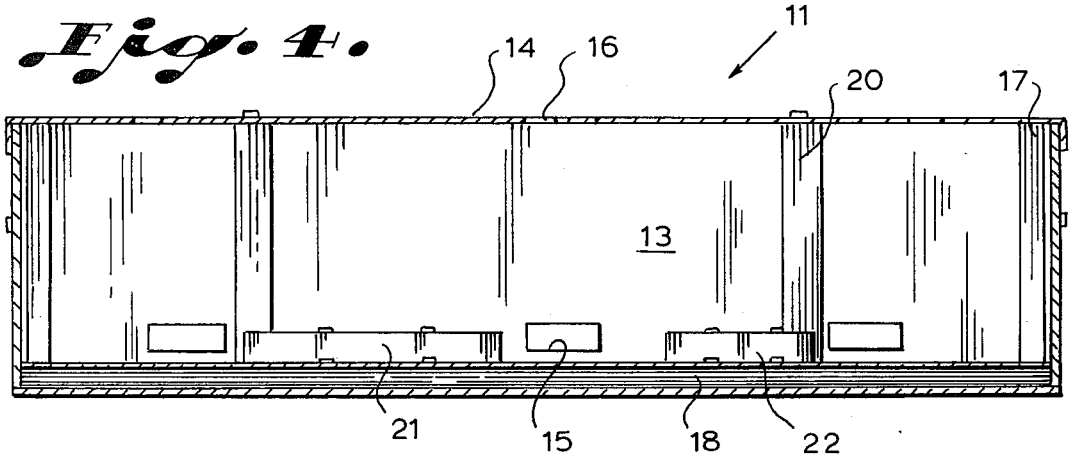
FIG. 4 is a side sectional view of the container of FIG. 1 through 3.
Figure 5:
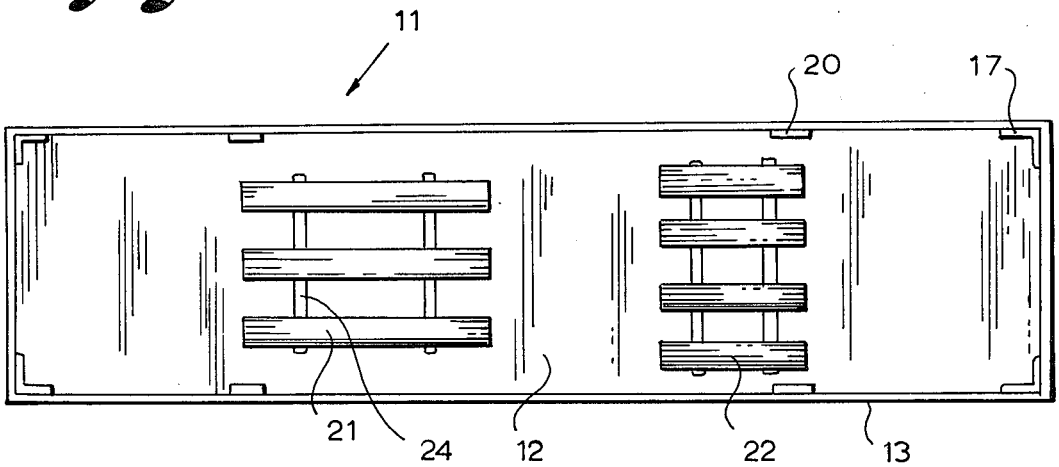
FIG. 5 is a top-plan view of the container having the top removed.

Referring to FIG. 1 of the drawings, a sea going vessel 10 is illustrated on the sea 9 with a sea burial container 11 in accordance with the present invention being tossed into the sea.

FIGS. 2 through 5 more clearly illustrate the details of the burial container 11 having a base 12 a plurality of sides 13 and a top 14. The bottom portion of the sides 13 have openings 15 therethrough and the top 14 has a plurality of openings 16. In addition, the container has corner reinforcing members 17, as well as a reinforced or strengthed corrugation 18 located in the base 12 and may have a plurality of side reenforcements 20. In the container are two sets of a plurality of weights 21 and 22, each weight being an elongated formed concrete member to increase the weight of the burial container and body therein. The term weight used herein to mean a mass for increasing the weight or gravitational force. The sets of weights 21 and 22 are each made-up of a plurality of individual formed concrete members 23 having a pair of straps 24 and 25 molded through the concrete members 23 holding them together into the set 21. Straps 24 and 25 can then be wrapped around the corpse being buried at sea; and with two sets of weights 21 and 22, one set can be strapped around the leg portion of the body while the other is strapped around the arms and chest portion. Advantageously, this holds the body to the sea bed even through the container 11 may break-up or disintegrate. The sets of weights 21 and 22 may be attached to the base 12 if desired to hold them in place for shipping and handling the containers; but will work equally as well if held by the weight of the masses 21 and 22. Thus, if the burial container is tossed into the ocean it will immediately fill with water rushing into openings 15 in the side and through the openings 16 which prevent the accumulation of air in the top of the container; thereby preventing the container from floating while the weights 21 and 22 force the container and the corpse to the bottom of the sea. The top 14 may have a pair of straps 26 wrapped around the entire burial container 11 for insuring that this top 14 stays in place. One or more straps 19 can be added to increase the strength of the container if desired. In addition, openings 15 and 16 may be taped or may be perforated for knocking out prior to burial to further seal the containers until just before the sea burial. The heavier reinforced base 12 with the side reinforements 17 and 20 allow a rigid container to be inexpensively made of paperboard.

The paperboard container is treated to protect it from disintegratng such as from inclement weather, or the like, prior to the burial. The paperboard container, may have its exterior coated with wax or other material and finished like wood grain for cosmetic effect. The container thereby gives a safe storage for corpses being shipped to sea for sea burial which will not break-up or disintegrate prior to the sea burial which will not let the corpse float to the surface if it does break-up or disintegrate after the sea burial. The burial container is made of inexpensive materials which may be mass produced to reduce the cost of burials over the expense of land burials. The body may be enclosed in a plastic log 29, or the like, for further protection prior to burial.

It should be clear at this point that a sea burial container has been provided which may be utilized for shipping bodies in the containers on vessels to sea and then used to bury bodies in a sea burial. Any suitable materials may be used such as having straps 19 and 26 made of metal or flexible straps, or any material that is sufficiently strong to hold the top on the container or to further hold the container together until after the sea burial. The straps 24 should preferable be made of a flexible strap material such as nylon or other polymer or material which is strong but will not rapidly disintegrate. The reinforcements 20, 17 and 18 can be made of paperboard such as corrugated paperboard or may be made of masonite, chipboard, wood or any material desired which would add reinforcing to the container. The present invention is, however, not to be construed as limited to the particular forms disclosured herein which are to be regarded as illustrative rather than restrictive.

I claim:

1. A marine burial container comprising in combination:

a paperboard container shaped to receive a corpse for burial; said container having a base with reinforcing material therein and a plurality of sides and said container having a plurality of reinforcing members attached to the sides of said container to increase the rigidity of said container;

weight means located to add weight to said container and to said corpse to reduce the buoyancy of the container and corpse;

means for connecting said weight means to said corpse; and said container having openings therein at predetermined locations to release entrapped air and allows water in to reduce the buoyancy of said container.

2. The burial container in accordance with claim 1 in which said means for connecting said weight means to said corpse includes flexible members attached to said weight means which may be connected around said corpse.

3. The burial container in accordance with claim 2 in which said flexible members are flexible straps.

4. The burial container in accordance with claim 3 in which said weight means includes having at least one strap passing through each set for strapping around a corpse placed in said container.

5. The burial container in accordance with claim 4 in which said burial container has a top and each set of weights is attached to said base.

6. The burial container is accordance with claim 1 in which said container is made of paperboard treated on its exterior with wax to prevent rapid disintegration.

7. The burial container in accordance with claim 1 in which said container is made of paperboard having a decorative water resistance exterior surface thereon.

8. The burial container in accordance with claim 7 in which said top is removable and has a plurality of openings therein.

9. The burial container in accordance with claim 8 in which the bottom portion of at least one side of said container has a plurality of openings therein.

10. The burial container in accordance with claim 4 in which each set of weights has a plurality of elongated concrete members with said straps passing therethrough.

11. The burial container in accordance with claim 8 in which said top is removable and has a plurality of straps there around for holding said top to said container.

* * * * *